US005692632A

United States Patent [19]

Hsieh et al.

[11] Patent Number: 5,692,632

[45] Date of Patent: Dec. 2, 1997

[54] CONTAINER WITH A SELF-CONTAINED EVACUATION LID

[76] Inventors: Chien-Hsing Hsieh, No. 111, Kuang Chou 2nd Street; Chung-Liang Hsiao, 3F, No. 60, Shu Lin Street, Sec. 2, both of Tainan, Taiwan

[21] Appl. No.: 640,466

[22] Filed: May 1, 1996

[51] Int. Cl.[6] ..... B65D 31/04

[52] U.S. Cl. ..... 220/212; 220/240; 215/228; 215/262; 215/270

[58] Field of Search ..... 215/228, 262, 215/260, 270, 311, 315; 220/212, 231, 240, 203.11, 203.23, 203.27, 203.28, 203.29, 367.1, 374

[56] References Cited

U.S. PATENT DOCUMENTS 5,390,809 2/1995 Lin ..... 220/212
5,406,992 4/1995 Miramon ..... 141/65
5,469,979 11/1995 Chiou ..... 215/228
5,546,997 8/1996 Miramon ..... 141/65
5,558,243 9/1996 Chu ..... 220/212
5,564,480 10/1996 Chen ..... 141/65
5,564,581 10/1996 Lin ..... 215/228

*Primary Examiner*—Stephen Cronin
*Attorney, Agent, or Firm*—Morton J. Rosenberg; David I. Klein

[57] ABSTRACT

This invention relates to a container with a self-contained evacuation lid. The container is provided for preserving food and is closed on the top by the evacuation lid. The lid includes a piston rod to be reciprorated up and down such that air inside the container is pumped out. An elastic element is fitted under the piston rod to bias a depressed part of the lid upward for an upward stroke when the depressed part is released after the downward movement. A valve rod is pulled to release the vacuum of the container for removal of the lid.

1 Claim, 6 Drawing Sheets

CONTAINER WITH A SELF-CONTAINED EVACUATION LID

OBJECT OF THIS INVENTION

The main object of the present invention is to provide a container with a self-contained evacuation lid. The container has a container body to house food therein and the evacuation lid forms a closure over the container body such that the lid can be depressed and released in a reciprocating manner to pump out air inside the container body to preserve the food substantially without air around.

SUMMARY OF THE INVENTION

The present invention relates to a container with a self-contained evacuation lid, comprising a container body for containing food therein having an annular round top lip, and said evacuation lid.

The evacuation lid includes a cover bottom, a piston rod, a mediate cover section, a cover top section, an annular connector, and a valve rod.

The cover bottom comprises an annular wall, an operational chamber, and a ventilating channel. The annualar connector is connected with the cover bottom, and has an annular supporting section to rest against said annular round top lip of the container body to form a closure over the container body.

The operational chamber is defined by said annular wall. The ventilating channel is arranged next to said annular wall and connected with a socket with apertures formed in between, and has a coned hole formed between the annular wall and the ventilating channel, and a through hole formed on the ventilating channel opposing the coned hole.

The mediate cover section is connected with both said cover bottom and said cover top section and has a hollow cylinder in a center thereof. The cover top section includes a flexible portion with a truncated top to connect with a depressed part having holes.

The piston rod includes a rod portion and a piston head section; said rod portion is passed through said hollow cylinder of the mediate cover section, and connected to said depressed part with apertures formed in between. The piston head section is housed within said operational chamber, connected to an elastic element, and has an annular trench having air through holes and encircled by an airtight ring.

The airtight ring tightly blocks up said air through holes of said annular trench in downward movement of said piston rod, and releases the blockage on said air through holes in upward movement of the piston rod. The valve rod is passed through said coned hole, said through hole of said ventilating channel, and a hole of said mediate cover section, and capable of blocking and ventilating said coned hole and said through hole of said ventilating channel by means of a coned protrusion and a mediate protrusion respectively.

The elastic element biases said piston rod upward after said depresed part is depressed and released; in said depressing motion, said coned protrusion releases the blockage on said coned hole, and air contained inside said container body flowing to said operational chamber through a path formed by said apertures between said ventilating channel and said socket, said ventilating channel, and said coned hole; in said releasing motion, air within said chamber is forced to flow out through a path formed by said holes of said annular trench of said piston head section, said operational chamber, said rod portion of said piston rod, said apertures between said rod portion and said depressed part, and said holes of said depressed part.

BRIEF DESCRIPTION OF THE DRAWINGS

The invention will be better understood by reference to the accompanying drawings, wherein.

DESCRIPTION OF THE PREFERRED EMBODIMENTS

Figure 1:
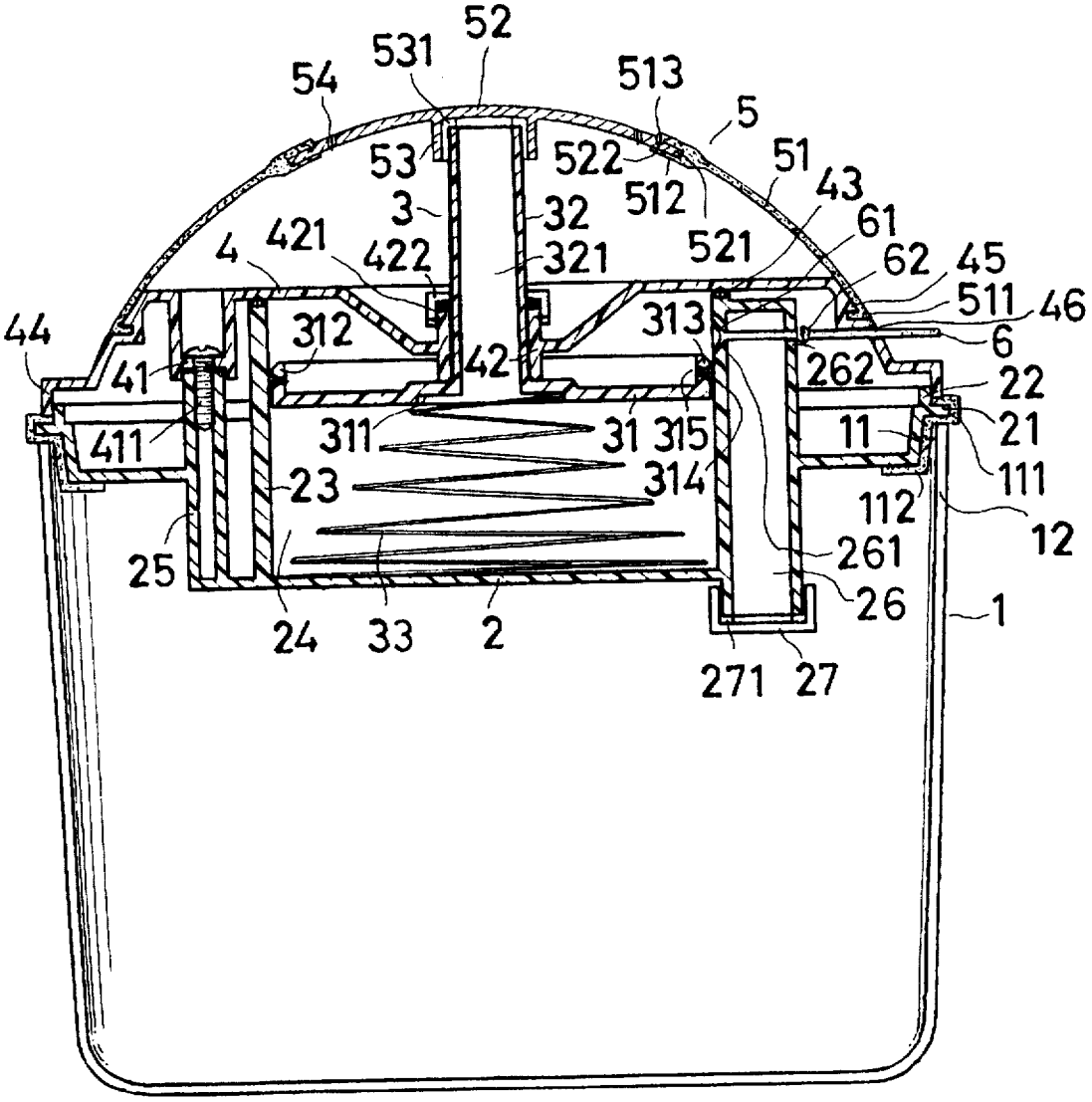
FIG. 1 is a section view of a container with a self-contained evacuation lid of the present invention.

The present invention relates to a container with a self-contained evacuation lid. Referring to FIG. 1, the container comprises a container body 1, and an evacuation lid including a cover bottom 2, a piston rod 3, a mediate cover section 4, a cover top section 5, and a valve rod 6 as the main parts.

The container body 1 is provided to preserve food therein, and is shaped to have an annular round top lip 12.

The cover bottom 2 has an annular protrusion 21, an annular vertical section 22, an annular wall 23, an operational chamber 24, a plurality of bored poles 25, and a ventilating channel 26. An annular connector 11 is provided, having an annular retaining groove 111 to firmly hold the annular protrusion 21 of the cover bottom 2 therein, and an annular supporting section 112 to rest on an inner side of the annular round top lip 12. The operational chamber 24 is defined by the annular wall 23 circumferentially. The bored poles 25 are arranged around the annular wall 23 at an equal interval. The ventilating channel 26, preferrably shaped cylindrical, is arranged next to an outside of the annular wall 23 and is connected with a socket 27 on a bottom thereof with a plurality of L-shaped pads 271 disposed in between such that apertures are formed between the bottom thereof and the socket 27. Furthermore, a coned hole 261 is formed between an upper portion of the annular wall 23 and the channel 26, and a through hole 262 is formed on the channel 26 opposing the coned hole 261.

The piston rod 3 includes a piston head section 31, and a rod portion 32. The piston head section 31 is arranged inside the operational chamber 23, substantially shaped round with a center communicating a hollow air channel 321 of the rod portion 32, and further has a recessed rection 311 on a bottom thereof to detain a top of an elastic element 33, of which a bottom is disposed on an interior bottom of the operational chamber 24. An annular convex portion 312 extends from an uppper perimeter of the piston head section 31, and also, referring to FIG. 5, has an annular trench 313 on an outward circumference thereof with a plurality of air through holes 315. An airtight ring 314 is disposed around the annular trench 313 to touch the annular wall 23 tightly.

The mediate cover section 4 has assembly holes 41 to be connected with the bored poles 25 of the cover bottom 2 by means of screws 411 such that the section 4 and the cover bottom 2 are combined together. The section 4 has a hollow cylinder 42 on a center, through which the rod postion 23 is passed. An annular airtight unit 421 housed inside an airtight cover 422 is fitted on a top of the hollow cylinder 42 to prevent air from leaking therethrough. Also ,an annular sealing unit 43 is anchored to the joint between the mediate cover section 4 and a top of the annular wall 23 to prevent air from leaking therethrough. The section 4 further has an annular edge 44, which is connected with both the annular vertical section 22 of the cover bottom 2 and the annular connector 11, and has a ventilating hole 46 aligned with both the coned hole 261 and the through hole 262. An annular engaging groove 45 is provided to retain an interior annular flange 511 of a flexible portion 51 of the cover top section 5 such that the sections 4 and 5 are combined.

The cover top section 5 is formed by the flexible portion 51 made of rubber material or any flexible material and a depressed part 52. The flexible portion 51 is shaped as a part of a sphere with the top truncated to connect with the depressed part 52. The truncated top has a retaining channel 512 having an engaging protrusion 513 to hold an annular edge 521 of the depressed part 52 with the engaging protrusion 513 fitted onto an annular concave 522 of the depressed part 52 for firm connection. A retaining socket 53 extends from the depressed part 52 and has a plurality of L-shaped pads 534 arranged at an equal interval therein. The rod portion 32 of the piston rod 3 is held within the socket 53 at a top ,and in turns apertures are formed between the rod portion 32 and the socket 53 by means of the L-shaped apertures 531. Furthermore, a plurality of holes 54 are bored on the depressed part 52.

The valve rod 6 is made of flexible materials and has a coned protrusion 264 at a front end, and a mediate protrusion 262 at a mediate portion thereof, which protrusions 261, 262 are capable of being movably fitted onto the coned hole 261, and the through hole 262 respectively. The other end of the valve rod 6 is passed through the ventilating hole 46 of the mediate cover section 4.

Figure 2:
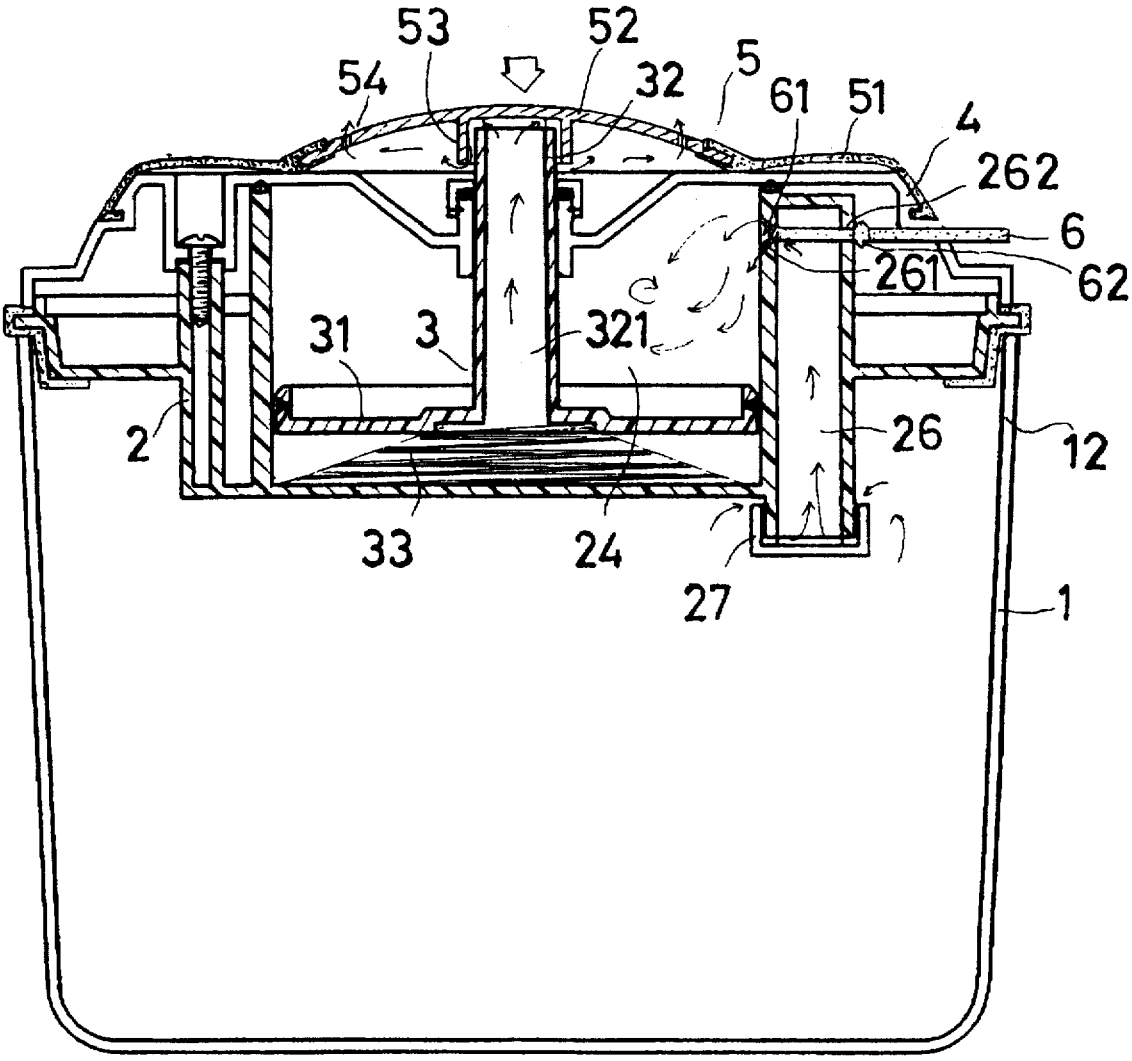
FIG. 2 is a view showing the container of FIG. 1 in depresseed motion and flow of air.
Figure 3:
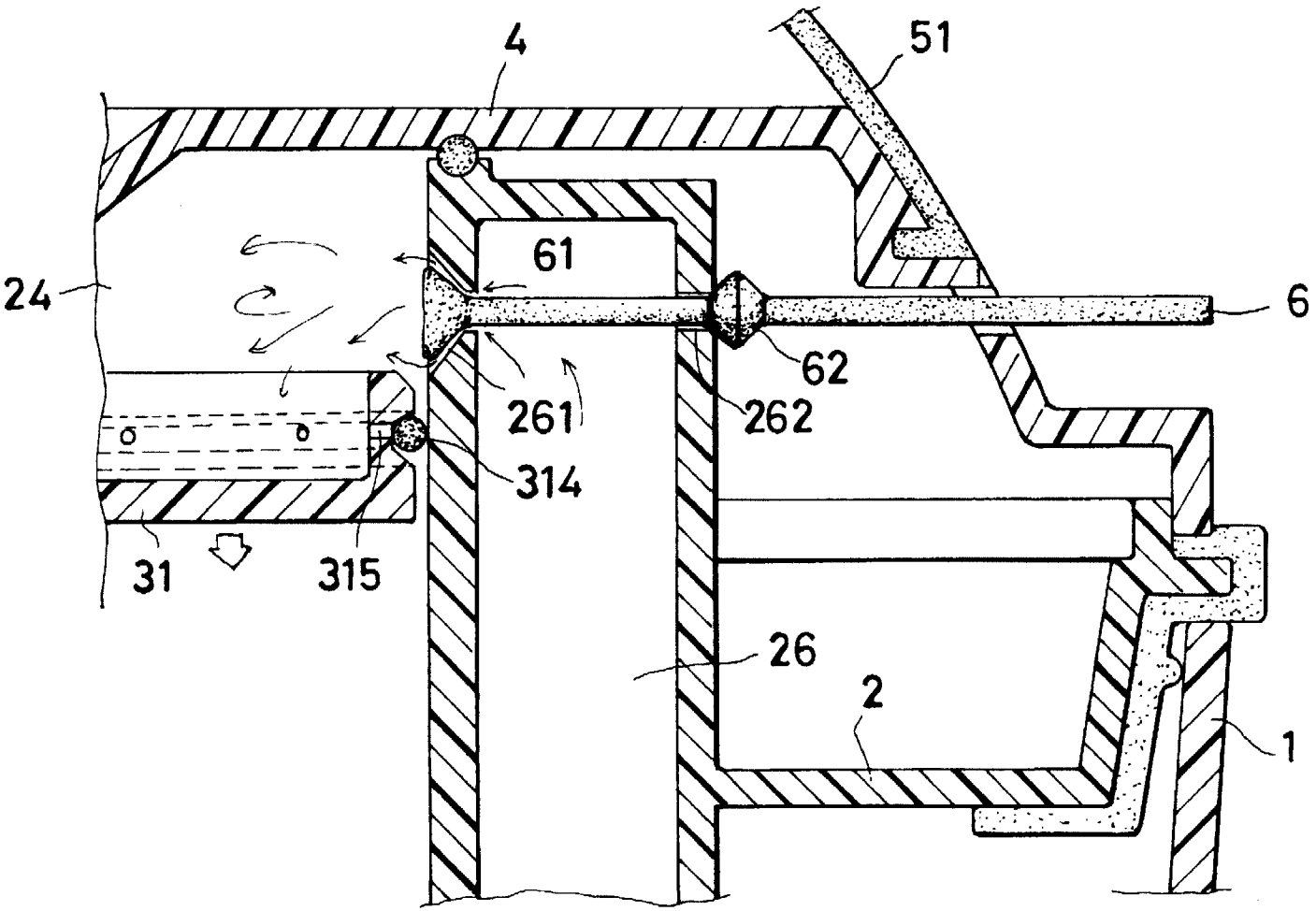
FIG. 3 is a view showing a fragment of FIG. 2 in an initiative stage of the depressed motion.
Figure 4:
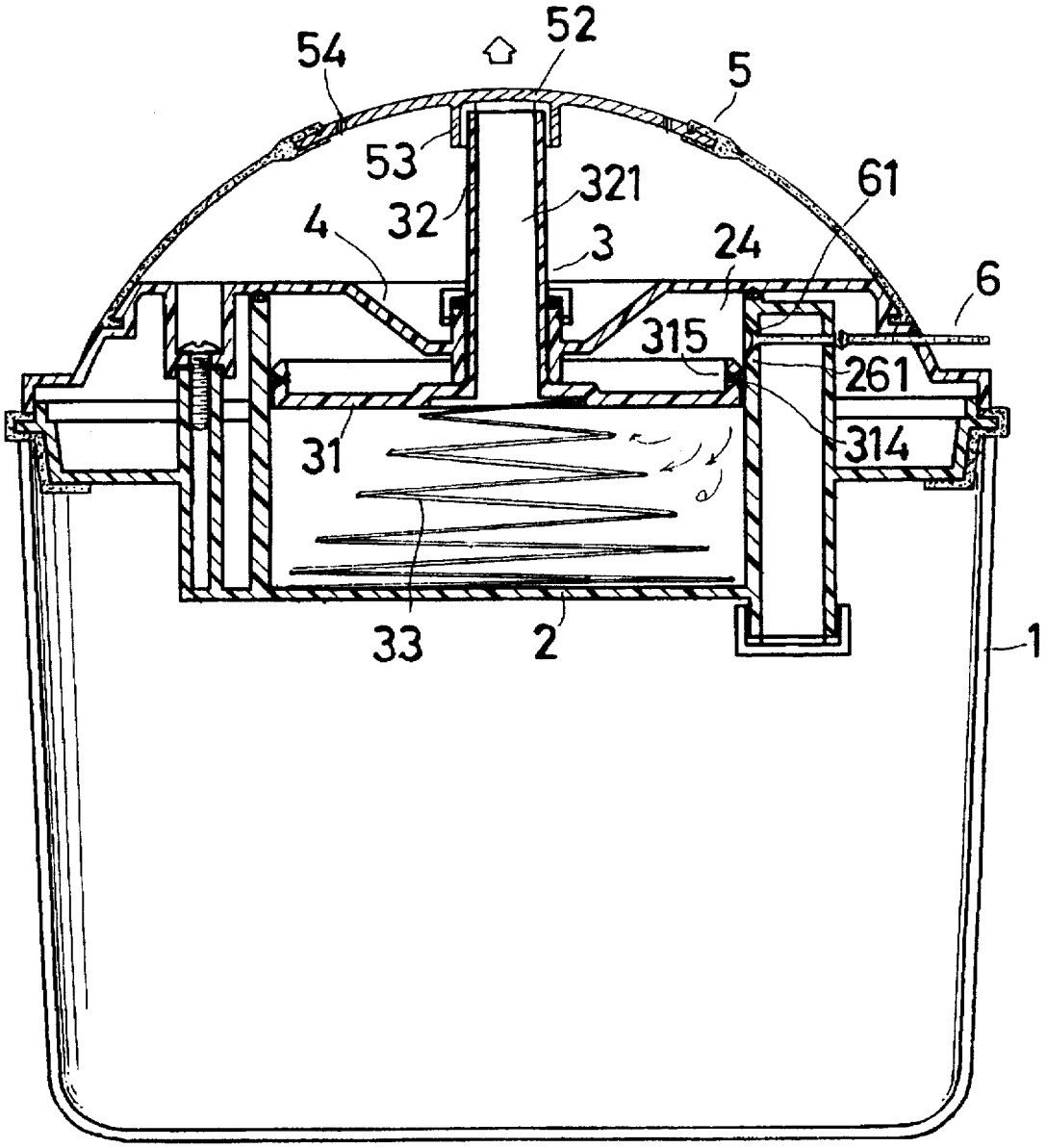
FIG. 4 is a view showing both the container of FIG. 1 in released motion after the depressed motion and flow of air.

In operation, the depressed part 52 is reciprocatingly depressed manually to pump out air contained in the container. When the depressed part 52 is depressed, referring to FIGS. 2 and 3, the flexible portion 51 moves to sit over the mediate cover section 4, and the piston rod 3 moves downward and at the same time depresses the elastic element 33. Thus, air inside a lower part of the operational chamber 24 defined by the piston head section 31 is forced to flow to outside through the hollow air channel 321, the apertures between both the rod portion 32 and the retaining socket 53, and the holes 54 in downward movement of the piston head section 31, and meanwhile the airtight ring 344 seals up the air through holes 315. Air inside the operational chamber 24 above the piston head section 31 also gets thinner due to enlargement of space such that a suction is formed to suck the valve rod 6 inwardly of the chamber 24. In turns, there is formed an aperture between the the coned protrusion 61 and the coned hole 261, while a still closer connection is formed between the through hole 262 and the mediate protrusion 62 such that air contained in the container body 1 flows into the part of the chamber 24 above the piston head section 3 through the apertures between both the socket 27 and the ventilating channel 26, and then through the channel 26, and the coned hole 261.

The depressed block 52 is released to be biased upward by the elastic element 33 for an upward stroke of the reciprocating movement of the depressed part 52. Meanwhile, the piston rod 3 moves upward, and in turns said air withdrawn from the container body 1 to the part of the chamber 24 above the piston head section 3 forces the coned protrusion 61 to block up the coned hole 261 and also flows to outside through the air through holes 315, then through the hollow air channel 321, the apertures between both the rod portion 32 and the retaining socket 53, and eventually through the holes 54 of the depressed part 52, the airtight ring 314 lifting to release the blockage on the air through holes 315 in the upward movement of the piston head section 31.

The above said depressing and releasing motion is repeated until air inside the container body 1 is substantially thoroughly pumped out.

Figure 5:
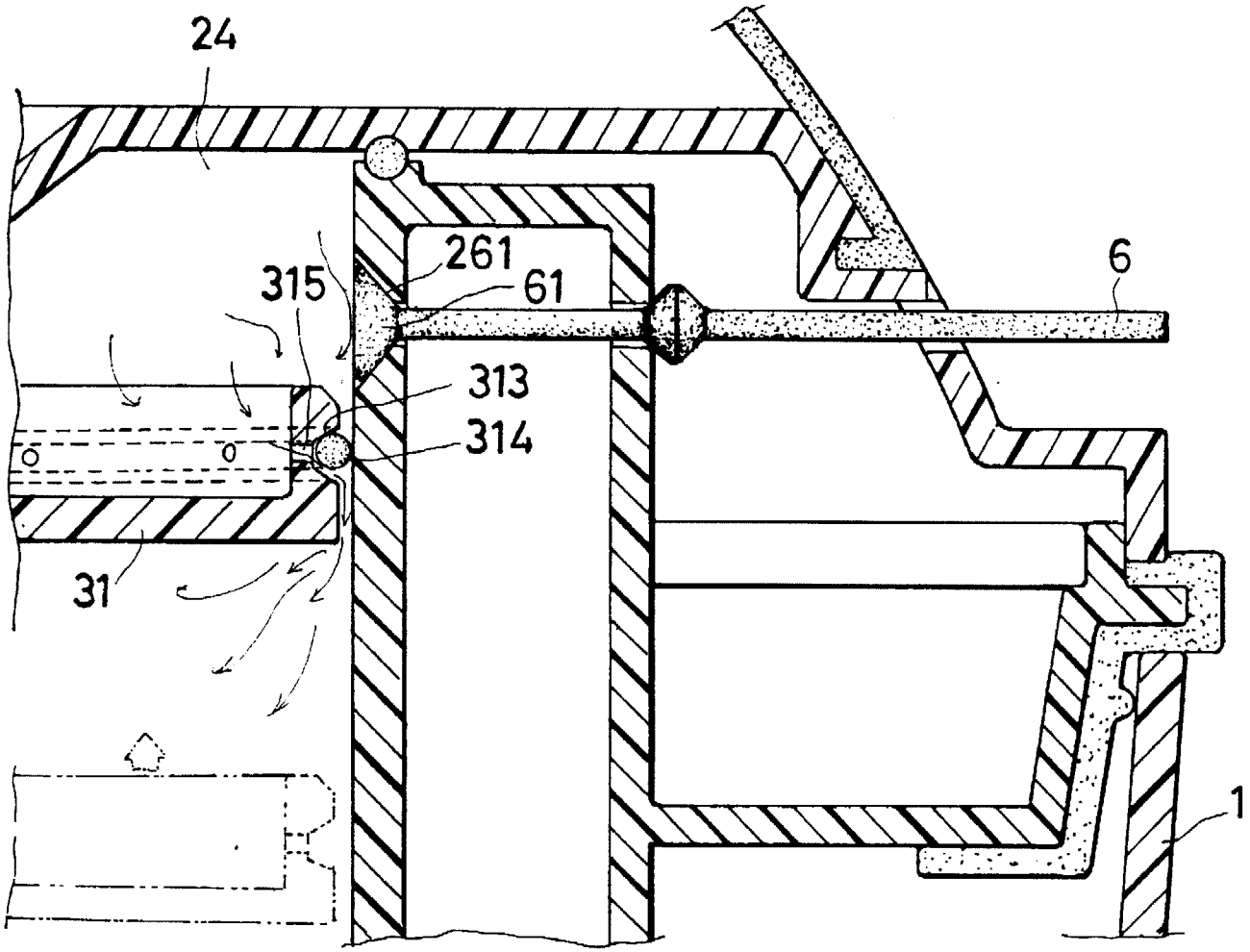
FIG. 5 is a view showing a fragment of FIG. 4.
Figure 6:
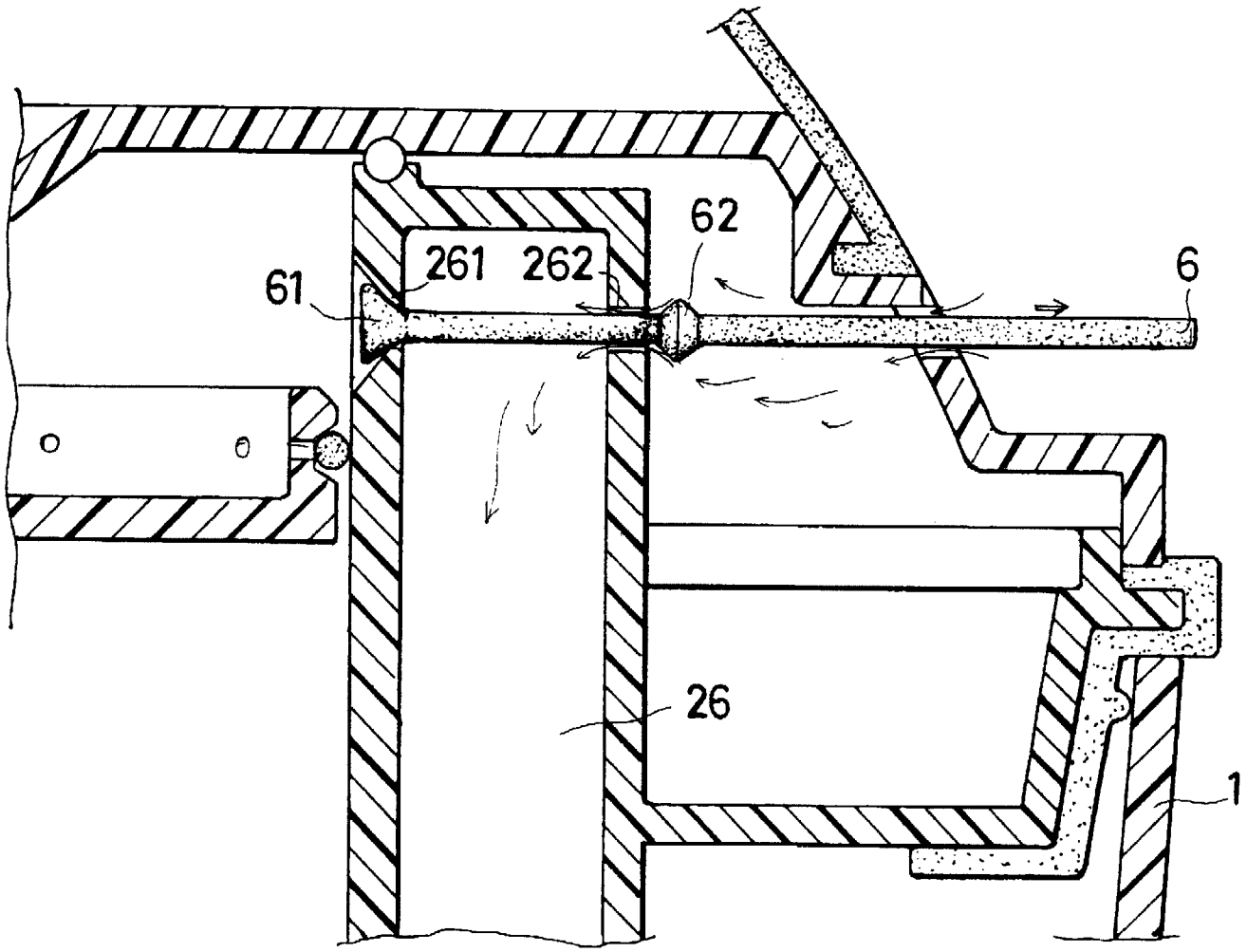
FIG. 6 is a view showing the operation for releasing the vacuum.

In release the vacuum of the container body 1 for removal of the evacuation lid, the valve rod 6 is first pulled outward. Referring to FIG. 5, when the rod 6 is pulled outward, the mediate protrusion 62 releases the blockage on the through hole 262 such that air can hlow into the container body 1 through a path formed by the ventilating hole 46, the through hole 262, the ventilating channel 26, and the apertures between the channel 26 and the socket 27.

From the above description, this invention can be known to have advantages as follows:

1. the piston rod 3 is incorporated into the evacuation lid so it is less likely to lose the rod 3, in comparison with a separate rod;

2. the parts to be depressed, i.e. the piston rod 3, is arranged in the center of the container so that the depressing motion is stable;

3. because only reciprocating depressing and releasing motion is needed for evacuating operation, this invention can be used easily and conveniently.

While the preferred embodiments of the invention have been described above, it will be recognized and understood that various modifications may be made therein and the appended claims are intended to cover all such modifications which may fall within the spirit and scope of the invention.

What is claimed is:

1. A container with a self-contained evacuation lid, comprising a container body for containing food therein having an annular round top lip, and said evacuation lid;

said evacuation lid including a cover bottom, a piston rod, a mediate cover section, a cover top section, an annular connector, and a valve rod;

said cover bottom comprising an annular protrusion, an annular vertical section, an annular wall, an operational chamber, and a ventilating channel;

said annular connector including an annular retaining groove, and an annular supporting section; said annular retaining groove retaining said annular protrusion of the cover bottom to connect the cover bottom with the annular connector, said annular supporting section resting against said annular round top lip of the container body to form a closure over the container body;

said operational chamber being defined by said annular wall; said ventilating channel being arranged next to said annular wall and connected with a socket with a plurality of L-shaped pads disposed in between to form apertures, and having a coned hole formed between the annular wall and the ventilating channel, and a through hole formed on the ventilating channel opposing the coned hole;

said mediate cover section being connected with both said cover bottom and said cover top section and having a hollow cylinder in a center thereof;

said cover top section including a flexible portion with a truncated top to connect with a depress part having a plurality of holes;

said piston rod including a rod portion and a piston head section;

said rod portion being passed through said hollow cylinder of the mediate cover section, and connected to said depressed part with apertures formed in between;

said piston head section being housed within said operational chamber, connected to an elastic element disposed inside said chamber, and having an annular trench; said annular trench having a plurality of air through holes and being encircled by an airtight ring;

said airtight ring tightly blocking up said air through holes of said annular trench in downward movement of said piston rod, and releasing the blockage on said air through holes in upward movement of the piston rod;

said valve rod being passed through said coned hole, said through hole of said ventilating channel, and a hole of said mediate cover section, and capable of blocking and ventilating said coned hole and said through hole of said ventilating channel by means of a coned protrusion and a mediate protrusion thereof respectively;

said elastic element biasing said piston rod upward after said depresed part is depressed and released; in said depressing motion, said coned protrusion releasing the blockage on said coned hole, and air contained inside said container body flowing to said operational chamber through a path formed by said apertures between said ventilating channel and said socket, said ventilating channel, and said coned hole;

in said releasing motion, air within said chamber being forced to flow out through a path formed by said holes of said annular trench of said piston head section, said operational chamber ,said rod portion of said piston rod, said apertures between said rod portion and said depressed part, and said holes of said depressed part.

* * * * *